US005197452A

United States Patent [19]

Johnson et al.

[11] Patent Number: 5,197,452

[45] Date of Patent: Mar. 30, 1993

[54] LIQUID JET PROPELLED TRANSPORTER AND LAUNCHER TOY

[76] Inventors: Lonnie G. Johnson, 4030 Ridgehurst Dr., Smyrna, Ga. 30080; Bruce M. D'Andrade, 3 Ten Eyck Rd., Whitehouse Station, N.J. 08889

[21] Appl. No.: 829,771

[22] Filed: Feb. 3, 1992

[51] Int. Cl.[5] ..... F41B 11/08; A63H 27/26

[52] U.S. Cl. ..... 124/57; 124/69; 446/56; 446/212

[58] Field of Search ..... 446/56, 187, 211, 212, 446/186, 63; 124/57, 64, 65, 69

[56] References Cited

U.S. PATENT DOCUMENTS

| | | | |
|---|---|---|---|
| 2,733,699 | 2/1956 | Krinsky | 124/57 |
| 2,927,398 | 3/1960 | Kaye et al. | 446/212 |
| 3,046,694 | 7/1962 | Holderer | 446/212 |
| 3,121,292 | 2/1964 | Butler et al. | 446/212 |
| 3,271,033 | 9/1966 | Parker | 124/57 |
| 3,740,896 | 6/1973 | Glass et al. | 446/212 |
| 3,962,818 | 6/1976 | Pippin, Jr. | 446/212 |
| 4,411,249 | 10/1983 | Fogarty et al. | 124/64 |
| 4,897,065 | 1/1990 | Fertig et al. | 446/63 |
| 5,032,100 | 7/1991 | Goldfarb | 446/211 X |

*Primary Examiner*—Mickey Yu

*Attorney, Agent, or Firm*—Kenneth P. Glynn

[57] ABSTRACT

The present invention involves a liquid jet propelled transporter and launcher toy. The launcher has a housing with a reservoir for holding a predetermined amount of liquid therein less than the volume of a transporter container and related to that volume. There is a reservoir fill port and cap to enable a user to fill the reservoir and close it. The launcher has a jet tube receiver adapted to receive a jet tube of a transporter. A pump is connected to the housing with a manually actuated pump and a one way valve from the pump to the reservoir. There is a transporter latch mechanism located on the housing and a release for releasing the latch mechanism so as to launch a transporter. The transporter includes a container for receiving liquid from the reservoir of the housing and a jet tube extending from the container which is adapted to fit onto the jet tube located in the housing. The liquid is stored in the reservoir and then pumped into the propulsion container of the transporter by actuating the pump and further actuation of the pump creates positive air pressure and within the reservoir and within the propulsion container of the transporter. Thereafter, the transporter may be released to freely advance away from the housing by jet propulsion.

20 Claims, 3 Drawing Sheets

LIQUID JET PROPELLED TRANSPORTER AND LAUNCHER TOY

BACKGROUND OF THE INVENTION

1. Field of the Invention

The present invention is directed to a liquid jet propelled transporter and launch toy. More specifically, it is directed to a toy which propels a transporter (a vehicle, boat, plane, etc.) by a liquid air propulsion combination. Further, the present invention utilizes a liquid fill reservoir and pump whereby liquid is transferred from a reservoir into a transporter container and the device is subsequently pumped up to a significant positive pressure, and the transporter is subsequently released for propulsion. Thus, the present invention pertains in general to motive type toys which are launched by hand operation and the launched portion or transporter may be on land, in the air, on or under water.

2. Prior Art Statement

Toys involving launchers have been around for at least thirty or forty years and apparently emerged with modern rocketry, although not all such toys pertain directly to rockets. Over the years various types of jet-powered toys have been developed which rely upon pressurized liquid within a container in the projectile or transporter and/or rely upon pneumatic launching.

U.S. Pat. No. 2,733,699 issued to B. Krinsky describes a rocket toy using a pressurized launcher and a spring mechanism for initial thrust. Pressurized air is created by a hand pump and a resilient washer (42) is used to retard launching until adequate pressure is achieved.

U.S. Pat. No. 2,927,398 issued to Kaye et al describes a multi-stage rocket in which fluid within chambers in each of multiple stages of a rocket are pressurized and sequentially released. Similarly, U.S. Pat. No. 3,962,818 issued to Reginald Pippin describes a multi-staged rocket with mechanisms for pressurizing liquid within containers for each stage.

U.S. Pat. No. 3,740,896 to Marvin Glass et al describes a jet-powered vehicle wherein a wheeled vehicle has a chamber or container within it and has a launching device which includes an air pump with a one-way valve there is also clamp means for holding the vehicle in the charging position and a trigger means for releasing the clamping device following the charging of the chamber to permit the vehicle to be propelled by means of reaction of the jet drive.

U.S. Pat. No. 4,411,249 issued to Bonnie Fogarty et al describes a toy glider with a pneumatic launcher. In this device, a wristlet includes a pumping mechanism as well as a flexible conduit to which a glider may be attached the pump is used to pressurize and pneumatically project the glider.

U.S. Pat. No. 4,897,065 issued to John Fertig describes and a toy vehicle and hand held pneumatic launcher wherein the pumping mechanism has a piston and hollow cylinder designed for a particular type of grip of a child coupled with thumb or hand operation of the pump mechanism.

U.S. Pat. No. 5,032,100 issued to Adolf Goldfarb describes a toy vehicle and launcher which uses contractive power of liquid in a liquid expanded chamber to propel the vehicle. Here, a significantly large reservoir is utilized to fill and expand a bladder which is connected to and part of a transporter or toy vehicle it is the expanded, pressurized bladder with the air and water mixture which propels the vehicle as a result of the contraction of the bladder upon release of the vehicle.

Notwithstanding the prior art in this field, no patent teaches or renders obvious the present invention device which utilizes a launcher which has a reservoir which holds a predetermined amount of liquid such that the entire quantity of liquid is moved from the launcher reservoir into the transporter so as to create a predetermined volume mixture of liquid and air to maximize a two step liquid jet propulsion of the transporter upon launching.

SUMMARY OF THE INVENTION

The present invention involves a liquid jet propelled transporter and launcher toy. The launcher has a housing which includes a reservoir for holding a predetermined amount of liquid therein which is less than the volume of a transporter container and related to the volume of the transporter container. There is also a reservoir fill port and cap to enable a user to fill the reservoir and close it. The launcher also has a jet tube receiver and adapted to receive a jet tube of a transporter. A pump is connected to the housing and may be contained within the housing and this includes manual means for actuating the pump as well as a one way valve from the pump to the reservoir. There is a transporter latch mechanism located on the housing and means or the transporter for releasing the latch mechanism so as to launch a transporter. The transporter includes a container for receiving liquid from the reservoir of the housing as well as a jet tube extending from the container which is adapted to fit onto the jet tube receiver located in the housing. The transporter has a simulated transporting structure attached to the propulsion container. This may take the form of a plane, glider, rocket, land vehicle, water vehicle or under water vehicle. The liquid is first stored in the reservoir and then pumped into the propulsion container of the transporter by means of actuating the pump and further actuation of the pump creates a substantial positive air pressure within the reservoir and within the propulsion container of the transporter. Thereafter, the transporter may be released by the release means and freely advances away from the housing by jet propulsion. In preferred embodiments the water to air ratio and the air pressure itself are such that the transporter is transported in two different phases, one being a positive air pressure thrust and the other being a combination of air and liquid such as water to create a jet stream thrust.

BRIEF DESCRIPTION OF THE DRAWINGS

The present invention as described herein will be more fully understood and appreciated when taken in conjunction with the drawings appended hereto those drawings are as follows.

DETAILED DESCRIPTION OF THE INVENTION

The present invention toy has been developed to create a transporter which is jet propelled and which may be launched by hand utilizing a predetermined ratio of liquid to air in the transporter container and enabling the user to effectively accomplish this without the need for thinking about volumetric amounts of liquid and without the need for any measuring. Uniquely, the present invention toy includes a launcher which has a housing with a reservoir contained within it. This reservoir has a volume for a predetermined amount of liquid which is less than the volume of a transporter container which may be attached to it and this volume for the reservoir is related to the volume of the transporter container itself so as to have a repeatedly reliable quantity of liquid/air mixture in the transporter for launchings.

Thus, it is an object of the present invention to provide an advanced toy for launching vehicles, boats, submarines, planes, gliders, rockets, jets and any other form of transporter which can be imagined or may yet to be developed in an exciting and efficient manner.

Figure 1:
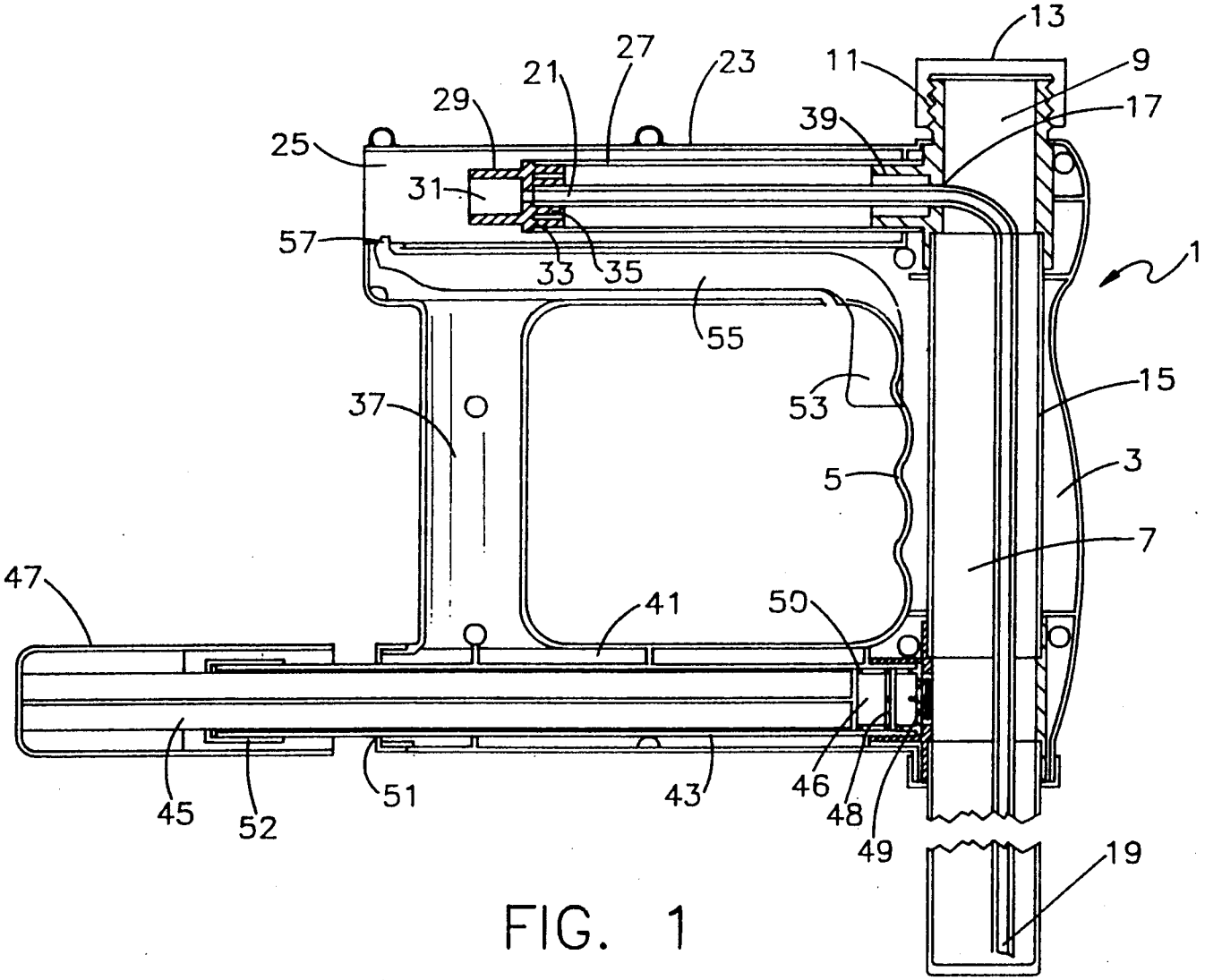
FIG. 1 shows a side cut view of a present invention launcher for launching an airborne liquid jet propelled transporter.

Referring now to FIG. 1, there is shown a side cut view of a launcher used as a component of the present invention toy. Launcher 1 includes launcher housing 3 which has a handle 5 as well as a housing reservoir 7. In this particular embodiment, reservoir 7 is proportioned to hold approximately three liquid ounces. Reservoir 7 includes a reservoir fill port 9 with threads 11 and reservoir cap 13. This enables the user to fill reservoir 7 and to close cap 13 thereafter with a predetermined, measured amount of liquid in the reservoir without the necessity for actually measuring or otherwise dealing with volumetric considerations for optimal use of the device.

Contained within reservoir 7 is pick-up tube 15. This runs from an inlet end 19 to an outlet end 21 and is effective in transferring liquid such as water from reservoir 7 to a transporter such as that discussed below in conjunction with FIG. 2. Note that the outlet end 21 of pick-up tube 15 is located within a transporter receiving tube 23 and further within a jet tube receiver 27. As will be discussed below, the jet tube receiver 27 inserts within a jet tube of a transporter (shown in FIG. 2) and that jet tube itself will slide into receiving tube 23. Receiving tube 23 includes an entrance 25, as shown. Additionally, jet tube receiver 27 is itself an annulus or tubing or piping configuration and has a female jet constriction receiver 31 with an outer fitting 33 which attaches to jet tube receiver 27 and an inner fitting 35 which attaches to outlet end 21 of pick-up tube 15. The housing 3 also includes, in this particular embodiment, upright front support 37. This is an optional feature which adds structural integrity to the housing.

Reservoir 7 includes a jet tube receiver fitting 39 with a reservoir outlet 17 for pick-up tube 15 passing therethrough, as shown.

Also, shown in FIG. 1 at the lower portion of the figure is a pump piston support 41 which includes a piston housing 43 and a piston rod 45 and a piston 46. Piston pump handle 47 covers the outer end of piston rod 45 and may be moved in and out so as to pump air into the reservoir 7 through one way valve 49 located adjacent to reservoir 7 and connected thereto, as shown. Pump fitting 51 supports piston rod 45 and piston housing cap 52. Air is taken into piston housing 43 at the opening around piston rod 45 at pump fitting 51. This occurs when piston pump handle 47 is pulled outwardly and ring 50 moves away from the sealing position and against inlet ridge 48 and air fills piston housing 43. When piston pump handle 47 is pushed inwardly, the air within the piston housing is forced by a one way valve 49 into reservoir 7 and the liquid such as water in reservoir 7 is transferred completely into the transporter, described below. Further pumping increases the air pressure in the reservoir as well as in a container of the transporter for subsequent propulsion of the transporter.

Figure 2:
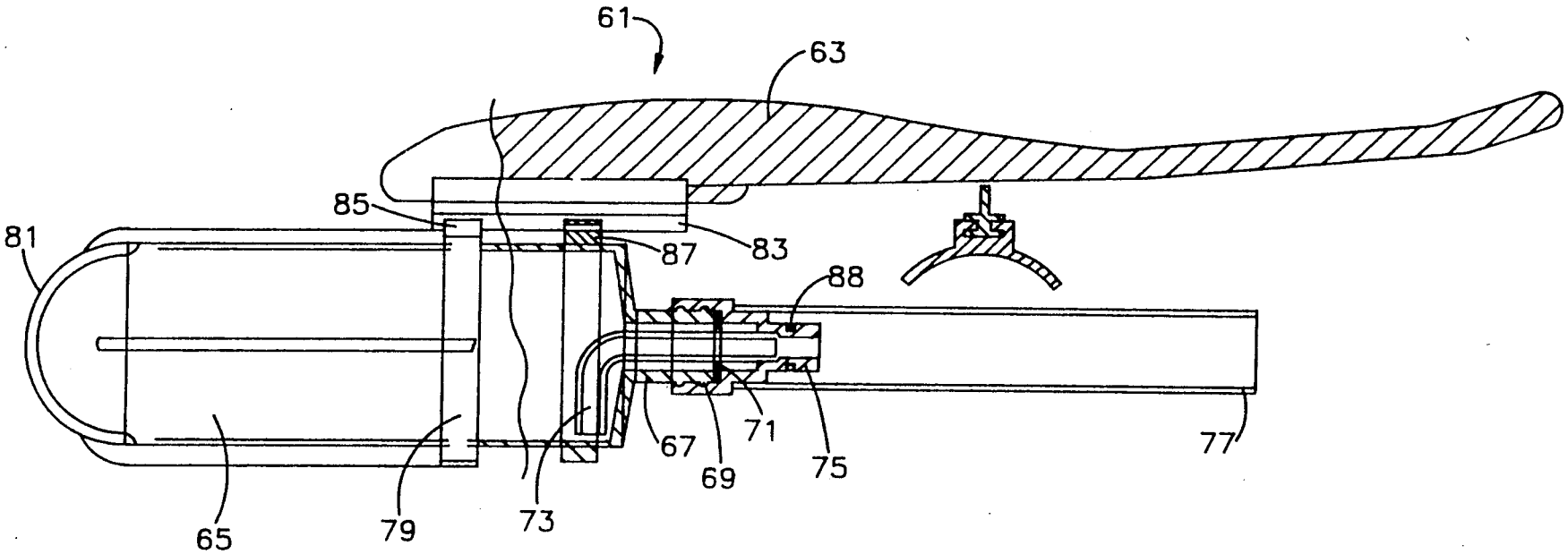
FIG. 2 is a side cut view of a transporter of the present invention toy device which, in this embodiment involves an airplane wing for airborne propulsion. This is for attachment to the launcher shown in FIG. 1; and, FIG. 3 shows a side perspective view of a portion of the transporter shown in FIG. 1, including the jet nozzle and container and harness assembly but excluding the airplane wing.

Housing 1 has located thereon trigger 53 which is connected by pivot 55 to transporter latch 57. When a transporter is inserted into receiving tube 23 and on to jet tube receiver 27, it may be secured in place via transporter latch 57. When the transporter and launcher is fully pumped up, the user may pull trigger 53 to release latch 57 and thereby allow the transporter to launch and be propelled, first by the air pressure in the launcher, and then by subsequent pressure release from inside jet tube 77, (FIG. 2). The initial air pressure from the launcher may be only for a second or so while the released pressure (and water jet stream) from the jet tube 77, (FIG. 2) may last for a number of seconds, e.g. 10 or 20 seconds.

Referring to FIG. 2, and taking a discussion thereof in conjunction with FIG. 1, there is shown in FIG. 2 a side cut view of a transporter 61 which may be utilized in conjunction with launcher 1 of FIG. 1. Transporter 61 includes a simulated vehicle, in this case an airborne vehicle represented by wing section 63. In addition, there is a propulsion container 65 having a neck 67 with threads 69, although the threads are not essential and they snap on or sealed arrangement would work sufficiently. Propulsion container orifice 71 has attached thereto a male jet constriction nozzle 75 which is adapted to be inserted into female jet constriction receiver 31 of launcher 1 and provide a tight seal by use of O-ring 88 or other sealing means. A dip tube 73 is connected to male jet constriction nozzle 75 and runs into propulsion container 65 as shown. Jet tube 77 likewise extends from the male jet constriction nozzle 75 and this is of sufficient shape and size to fit over jet tube receiver 27 and inside receiving tube 23 of housing 1 in FIG. 1. Transporter wing attachment 79 is utilized to connect the container 65 of the transporter with wing section 63 via wing guide 83. Wing attachment 79 and its counterpart 80 have wing guide receivers 85 and 87 connected thereon respectively to receive wing guide 83, as shown.

Figure 3:
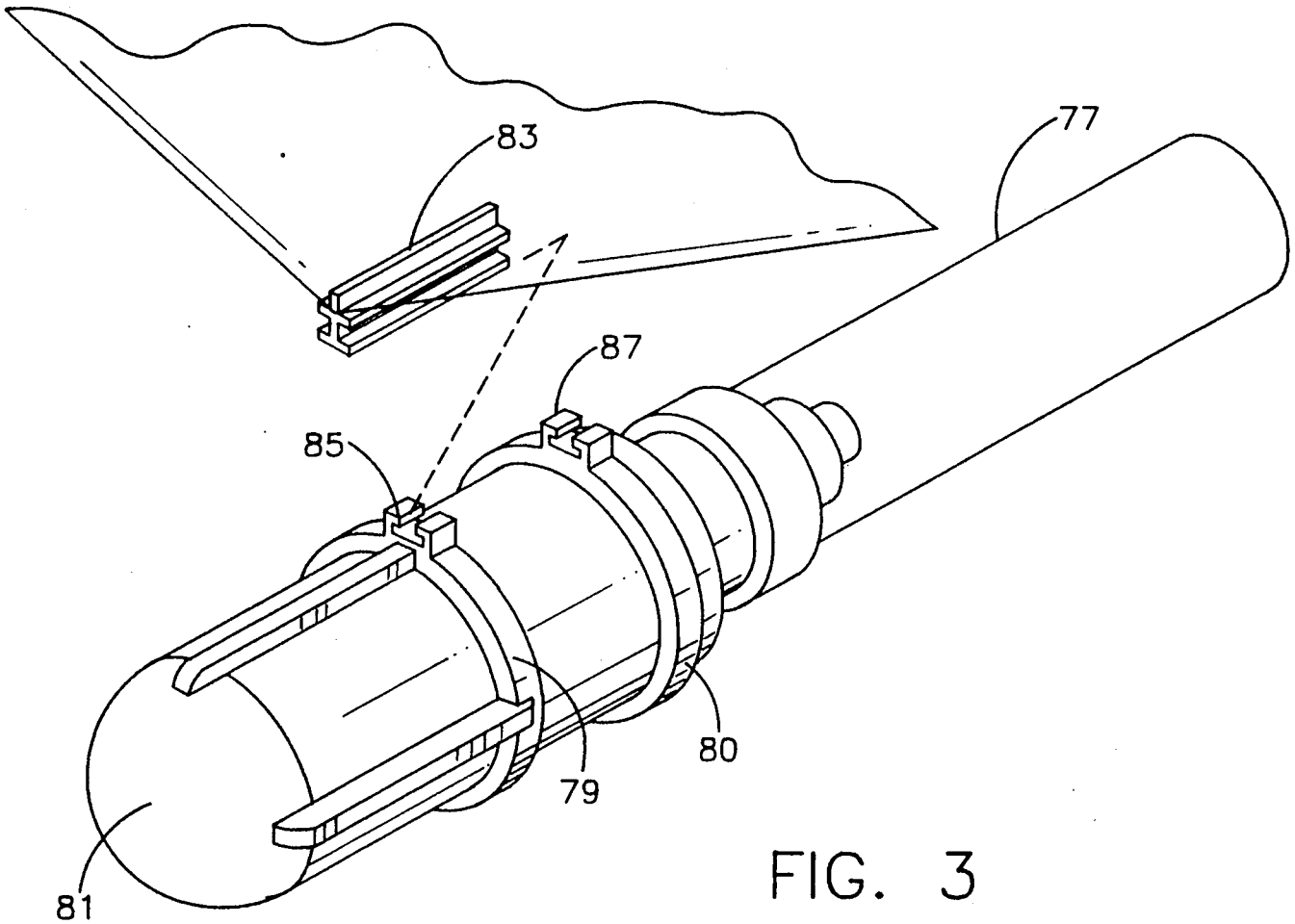

FIG. 3 shows a perspective side view of a portion of transporter 61 wherein parts identical to those shown in FIG. 2 are identically numbered. This perspective view shows guide 83 and its insertion into guide receivers 85 and 87 via the dotted line in FIG. 3. Likewise, it can be seen that nose cone bumper 81 is dome shaped may be constructed of a resilient structure such as a rubber or recoverable plastic material.

As mentioned above, and referring now to FIGS. 1, 2, and 3 collectively, transporter 61 is inserted into housing 3 as described above. Likewise liquid such as water is placed in reservoir 7 and cap 13 is secured. This is most preferably done before transporter 61 is attached to housing 3. Subsequently, using pump handle 47, the user pumps up the reservoir 7 so that the liquid therein moves into container 65 and continues to pump to create a substantial positive air pressure in both the reservoir 7 and the container 65. For example, a user may pump the air pressure up to as great as or greater than 70 pounds per square inch. Further, it should be noted that container 65 in this particular embodiment is formed to receive a total of four ounces of liquid. Since reservoir 7 only receives three ounces of liquid and all of that is pumped into container 65, approximately one-quarter of the volume will contain air. This approximate ratio of about 15% to about 40% of air, remainder liquid, and especially in the 20% to 30% air, remainder liquid, range, the transporter will propel by liquid jet propulsion in an optimum fashion. This is one important feature of the invention. It is the reservoir having a volume less than the volume of the container in the transporter that allows for all of the liquid to be moved from the reservoir to the transporter and for the transporter to always have the same, consistent ratio of air to liquid. This results in a release of the transporter and jet propulsion where two different forces act. First, a liquid air jet exits jet constriction nozzle 75 and subsequently once nozzle 75 exits jet constriction receiver 31 air pressure from the launcher executes an additional propulsion force between nozzle 75 and receiver pick-up tube outlet 29 where receiver pick-up tube outlet 29 acts as a piston and tube 77 acts as a cylinder. This provides the initial thrust which is so important for maximum performance in jet propelled items. (In previous devices, this initial push has been achieved by a spring). Once tube 77 is clear of receiver pick-up tube outlet 29 and transporter receiving tube entrance 25, the thrusting of the water jet takes over as the water jet is metered to last for a longer deviation, such as 10 to 30 seconds, as compared to the air thrust which typically may last less than a second. The construction of the present invention toy is typically various types of plastic and, once the invention is appreciated, the selection of soft and hard plastics for various components will be within the skill of the artisan. For example, high density polyethylene may be used for certain aspects whereas other plastics may be utilized, for example, the pick-up tube could be a typical vinyl tube and the fittings could be hard rubber fittings or otherwise. Additionally, some or all parts may be made of other materials such as materials typically available in the construction of toys, including ridged foams, metals, graphite, etc.

Obviously, numerous modifications and variations of the present invention are possible in light of the above teachings. It is therefore understood that within the scope of the appended claims, the invention may be practiced otherwise than as specifically described herein.

What is claimed is:

1. A liquid jet propelled transporter and launcher toy, which comprises:

(a) a launcher having a housing which includes a reservoir for holding liquid therein, a reservoir fill port, and a cap, and said housing having a jet tube receiver adapted to receive a jet tube of a transporter;

(b) a pump connected to said housing, said pump being connected for and capable of pumping air to said reservoir;

(c) a one way valve connected to said pump and permitting flow of air only from said pump to said reservoir and not vice versa;

(d) a transporter latch mechanism located on either of said housing or said transporter set forth below;

(e) means for releasing said latch mechanism;

(f) transporter which includes a propulsion container for receiving liquid and air under pressure from said reservoir of said housing, a jet tube extending from said propulsion container and adapted to fit onto the aforesaid jet tube receiver located in said housing, and a simulated transporter structure attached to said propulsion container;

wherein said container and jet tube may be attached to said housing with said jet tube located over said jet tube receiver and said latch holding said transporter in place thereon in a releasable fashion, further wherein liquid may be stored within said reservoir, and pumped from said reservoir to said propulsion container of said transporter by means of actuating said pump and further wherein a substantial positive air pressure may be created within said reservoir and within said propulsion container, after which said transporter may be released by said release means and may advance away from said housing by propulsion of said liquid and air contained within said propulsion container and said jet tube and said launcher.

2. The toy of claim 1, wherein said transporter structure is an airborne vehicle.

3. The toy of claim 1, wherein said transporter structure is an amphibious vehicle.

4. The toy of claim 1, wherein said transporter structure is a toy land vehicle.

5. The toy of claim 1, wherein said pump is a piston pump and said one way valve is located between a piston chamber and said reservoir.

6. The toy of claim 1, wherein said housing includes a handle and said release mechanism is a trigger.

7. The toy of claim 1, wherein said received also includes one of a jet constriction receiver or a jet constriction nozzle, and the other of a jet constriction receiver or a jet constriction nozzle is located within said jet tube of said transporter.

8. The toy of claim 1, wherein said propulsion container further includes a dip tube which extends from said container to a constriction receiver within said jet tube.

9. The toy of claim 1, wherein said housing includes an arrangement hereby said pump and said transporter are parallel to one another and spaced away from each other.

10. The toy of claim 9, wherein said transporter receiver and said pump are located in such a fashion as to be connected to one another rearwardly by said housing in the form of a housing handle and forwardly by a connecting structure.

11. A liquid jet propelled transporter and launcher toy, which comprises:

(a) a launcher having a housing which includes a handle, a reservoir for holding predetermined amounts of liquid therein which is less than the volume of a transporter container and related to the volume of the transporter container, a reservoir fill port and cap, and said housing having a jet tube receiver and adapted to receive a jet nozzle of a transporter;

(b) a pump connected to said housing, said pump being connected for and capable of pumping air to said reservoir;

(c) a one way valve connected to said pump and permitting flow of air only from said pump to said reservoir and not vice versa;

(d) a transporter latch mechanism located on either of said housing of said transporter set forth below;

(e) means for releasing said latch mechanism; and, (f) a transporter which includes a propulsion container for receiving liquid and air under pressure from said reservoir of said housing, a jet tube extending from said propulsion container and adapted to fit onto the aforesaid receiver located in said housing and a simulated transporter structure attached to said propulsion container;

wherein said container and jet tube may be attached to said housing with said jet tube located over said jet tube receiver and said latch holding said transporter in place thereon in a releasable fashion, further wherein liquid may be stored within said reservoir, and pumped from said reservoir to said propulsion container of said transporter by means of actuating said pump and further wherein a substantially positive air pressure may be created within said reservoir and within said propulsion container, after which said transported may be released by said release means and may advance away from said housing by propulsion of said liquid and air contained within said propulsion container and said jet tube and said launcher.

12. The toy of claim 11, wherein said transporter structure is an airborne vehicle.

13. The toy of claim 11, wherein said transporter structure is an amphibious vehicle.

14. The toy of claim 11, wherein said transporter structure is a toy land vehicle.

15. The toy of claim 11, wherein said pump is a piston pump and said one way valve located between a piston chamber and said reservoir.

16. The toy of claim 11, wherein said release mechanism is a trigger.

17. The toy of claim 11, wherein said receiver also includes one of a jet constriction receiver or a jet constriction nozzle, and the other of a jet constriction receiver or a jet constriction nozzle is located within said jet tube of said transporter.

18. The toy of claim 11, wherein said propulsion container further includes a draw tube which extends from said container to a constriction receiver within said jet nozzle.

19. The toy of claim 11, wherein said housing includes an arrangement whereby said pump and said transporter are parallel to one another and spaced away from each other.

20. The toy of claim 11, wherein said transporter receiver and said pump are located in such a fashion as to be connected to one another rearwardly by said housing in the form of a housing handle and forwardly by a connecting structure.

* * * * *